United States Patent [19]

Wilson

[11] 4,407,068

[45] Oct. 4, 1983

[54] HAIR CUTTER WITH VACUUM

[76] Inventor: Timothy W. Wilson, 2303 5th Ave. South, Apt. 2, Minneapolis, Minn. 55404

[21] Appl. No.: 357,847

[22] Filed: Mar. 15, 1982

[51] Int. Cl.[3] ..... B26B 19/44

[52] U.S. Cl. ..... 30/133

[58] Field of Search ..... 30/133, 201

[56] References Cited

U.S. PATENT DOCUMENTS

| | | | |
|---|---|---|---|
| 1,238,061 | 8/1917 | Bourdelat | 30/133 |
| 3,035,346 | 5/1962 | Campbell | 30/133 |
| 3,138,870 | 6/1964 | Stachon | 30/133 X |
| 3,900,949 | 8/1975 | Anzalone | 30/133 |
| 4,150,483 | 4/1979 | Kanazawa | 30/133 |
| 4,219,931 | 9/1980 | Vacilotto | 30/133 |
| 4,314,405 | 2/1982 | Park | 30/133 |

*Primary Examiner*—Jimmy C. Peters

[57] ABSTRACT

An implement for giving a haircut to a person; the implement including a molded plastic main body, for being held in a hand, and containing a circular cutter blade and fan rotated by an electric motor, and an adjustable nozzle in front of the cutter, for hair to be drawn therein by vacuum air force, and cut by the rotating cutter blades.

3 Claims, 13 Drawing Figures

HAIR CUTTER WITH VACUUM

This invention relates generally to hair cutting implements.

It is well known, that cutting hair on a person's head requires some skill, in order that the hair is attractively shaped, without unsightly steps caused by a scissors cutting off a large number of hairs together in a clump. Many persons attempting to do their own haircutting, without the services of a professional barber, end up with very poor results, so that this situation is, therefore, in need of improvement.

Accordingly, it is a principal object of the present invention to provide an aircutter for cutting hair, and wherein the hair is lifted straight out from the scalp, so that it is not bunched when clipped off, and which eliminates the above-described steps cut in the hair, while lying down close to the head.

Another object is to provide an aircutter, which utilizes a vacuum force for raising the hair straight out, and which includes a nozzle so as to confine lifting only the hairs intended to be clipped at any one moment, without disturbing the other hairs.

Another object is to provide an aircutter, which promotes a healthier growth of hair, and enables persons to cut their own hair well, and without a mess.

Other objects are to provide an air cutter, which is simple in design, inexpensive to manufacture, rugged in construction, easy to use and efficient in operation.

These, and other objects, will be readily evident, upon a study of the following specification, and accompanying drawing, wherein.

Figure 1:
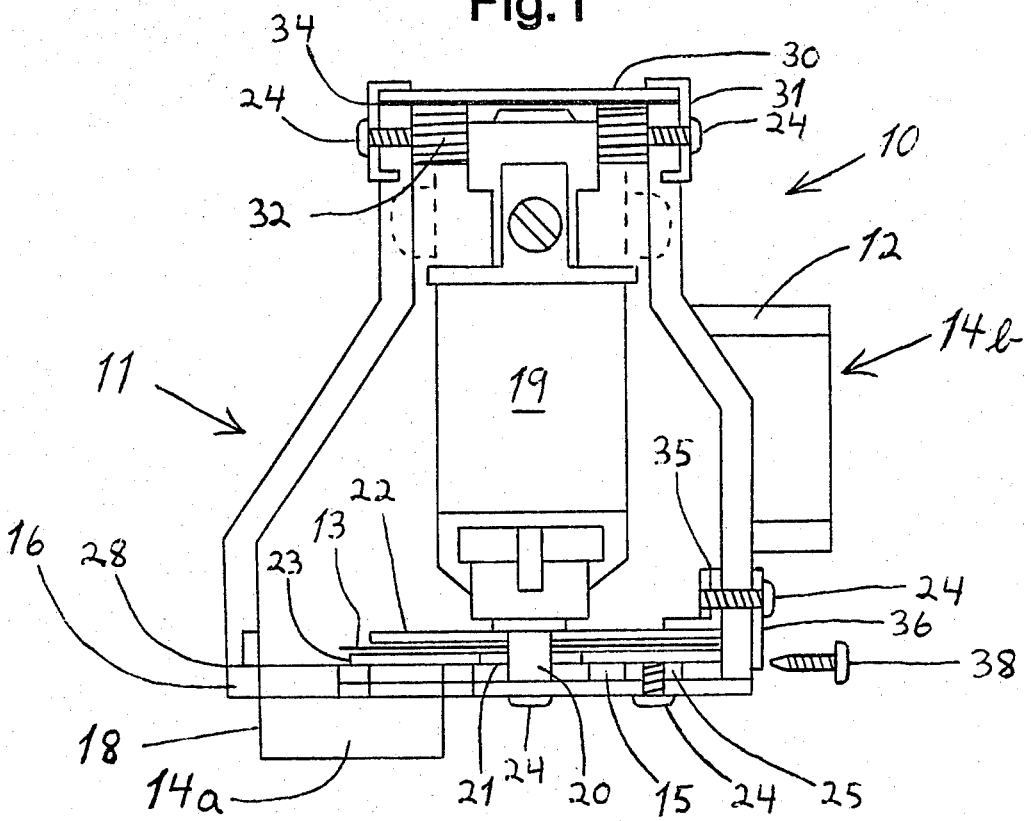
FIG. 1 is an exposed side view of the assembly with a set screw removed.
Figure 3:
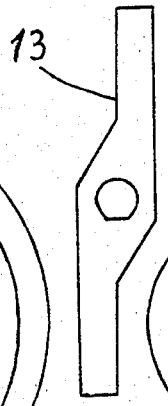
FIG. 3 is a face view of the cutter blade.
Figure 13:
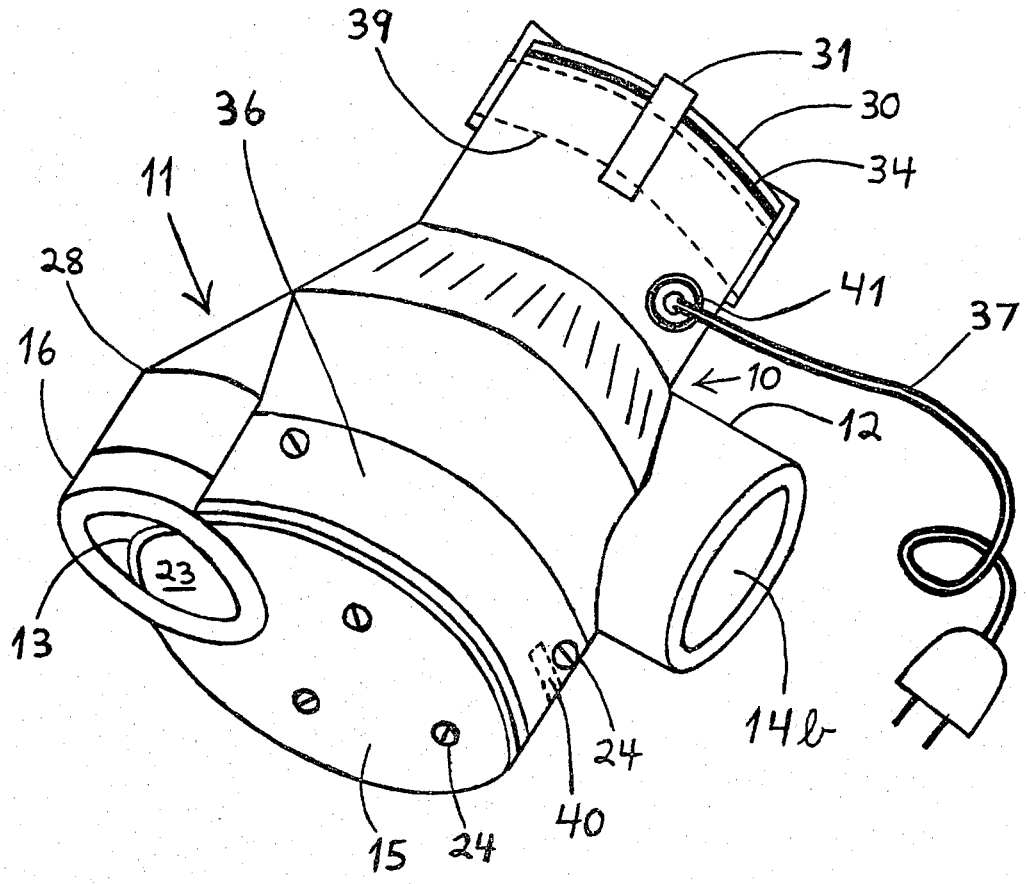
FIG. 13 is a perspective view of the assembled invention.

Referring now to the drawings in greater detail, the reference numeral 10 represents an air-cutter shown in FIGS. 1 and 13 according to the present invention, wherein there is a main body member, molded preferably of smooth hard plastic, so as to serve as a case 11. A cylindrical rear portion 12 of the case serves conveniently as a handle for being held in a hand and receives a taper end vacuum hose at 14*b*. A cutter blade 13 is supported rotatably in one end of the case, so that only a portion of the blade intercepts the tubular opening 14*a* with the lower support plate 23 which is spot welded 42 shown if FIG. 6 to the nozzle adapter 16 shown in FIG. 9, that are off the bottom cover 15 which is glued to the bottom case end shown FIG. 2. The bottom cover 15 may also be fastened to the case by welding it or by using a series of set screws 38. The bottom cover 15 has three layers and can be seen as two layers depending on the approach to construction and materials and it is built up of step flange designs which provide a multi-function base as can be seen and will be further explained later which fits inside to the bottom end of the case and its nose 28 section. The bottom cover 15 includes a wire grill 17, as a protective guard in front of the cutter blade that is welded to the lower support plate 23 and is welded also through holes in the nozzle adapter 16 shown in FIG. 10, preventing a finger contacting the rotating cutter blade 13.

A rotatable nozzle 18, on the bottom cover, communicates with the opening 14*a*, the latter extending through the tubular rear handle portion 12, and 14*b*. The nozzle is adjustable to a five inch length, and feathering of the hair length can be produced by tilting the case so that only a portion of the nozzle contacts the head.

Figure 4:
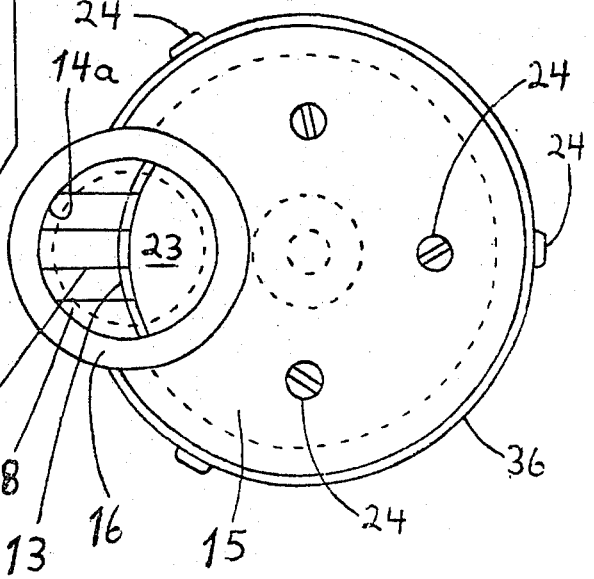
FIG. 4 is a bottom view of the assembly.
Figure 6:
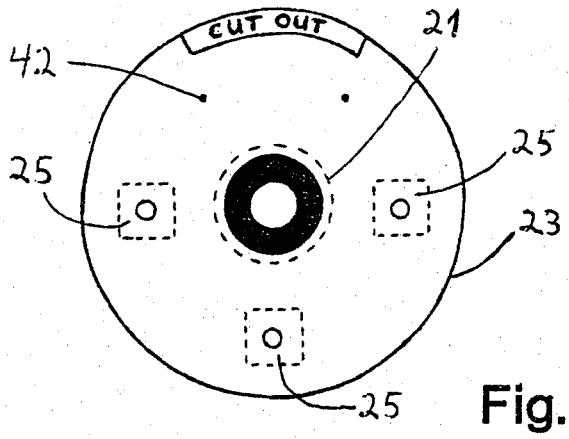
FIG. 6 is a top view of the lower support plate.
Figure 11:
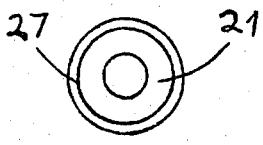
FIG. 11 is a top view of the thrust bearing.
Figure 12:
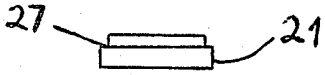
FIG. 12 is a side view thereof.

The present invention channels the vacuum suction for drawing the hair outward to be cut by a circular rotating cutter blade 13 as the hairs intercept the tubular opening 14*a* with the lower support plate 23 so as to pull air which draws the hair to the edge of the cutter blade 13. The cutter blade is retained on the motor shaft 20 and is between the upper support plate 22 and the lower support plate 23, and the motor shaft 20 is held in place by a step flange 27 design of the thrust bearing 21 shown in FIGS. 11 and 12 that connect into a hole of the lower support plate 23 shown in FIG. 6 and is held tightly there between layers of the bottom cover 15 by three set screws 24 shown in FIG. 4. The bottom cover 15 is made up of flanged layers. The thrust bearing 21 is partially through the lower support plate 23 and its center hole. The lower support plate has sheet metal square nuts 25 welded to its bottom side drilled and taped to accommodate the bottom cover 15 set screws 24. The lower support plate 23 has a notched out area slightly on its leading side removed as shown in FIG. 6 which allows the cutter blade 13 to cut the hair at the same diameter.

Figure 5:
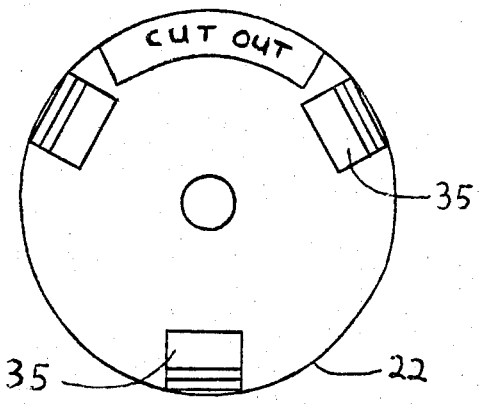
FIG. 5 is a top view of the upper support plate.

The upper support plate 22 is above the cutter and keeps the cutter stable and steady during operation and supports the motor 19 because the motor rests upon the upper support plate 22. It has a hole in the center for the motor shaft 20 to penetrate through it and the upper support plate 22 is notched out slightly but more than the lower support plate was notched out, and is shown in FIG. 5. This larger notched out area of the upper support plate 22 will allow more efficient air flow. The upper support plate 22 has three sheet metal rectangular tangs 35 which are welded to it. The tangs 35 are bent at 90 degrees and are built up by spot welding metal to them on one side. The tangs 35 are welded to the top of the upper support plate 22 and are drilled and taped to accommodate the set screws 24 that will hold it to the interior wall of the case 11 and at the same time connect a safety ring 36 to the lower exterior wall of the case. The safety ring 36 serves as a washer for the set screws 24 and provides an additional protection safety ring surrounding the upper and lower support plates 22 and 23 beyond the thickness or hardness of the case 11.

Figure 2:
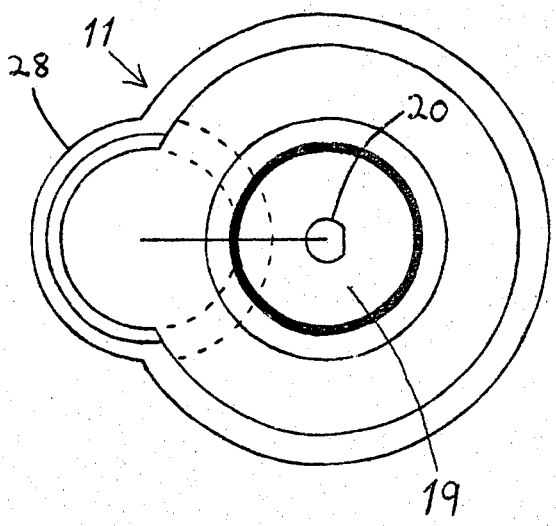
FIG. 2 is a perspective bottom view of the main body member case device.
Figure 9:
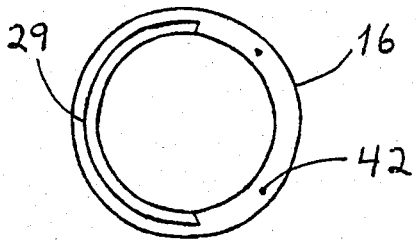
FIG. 9 is a top view of the nozzle adapter.
Figure 7:
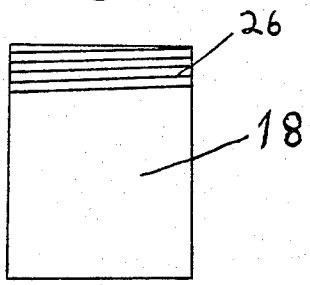
FIG. 7 is a side view of the rotatable nozzle tube.
Figure 10:
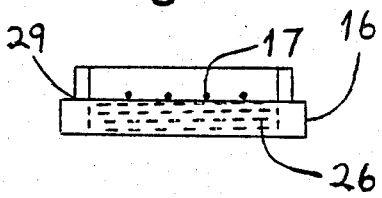
FIG. 10 is a side view of the nozzle adapter with screw threads and safety wire shown.

A nozzle adapter 16 shown in FIGS. 9 and 10 connects a rotatable nozzle tube 18 with screw threads 26 shown in FIG. 7 and FIG. 10. The nozzle adapter 16 is fitted into the nose 28 section of the case as shown in FIGS. 1 and 2 with a stepflange 29 design on the nozzle adapter 16. The nose 28 when assembled is sealed simply with a good piece of adhesive tape so it's air tight there.

Figure 8:
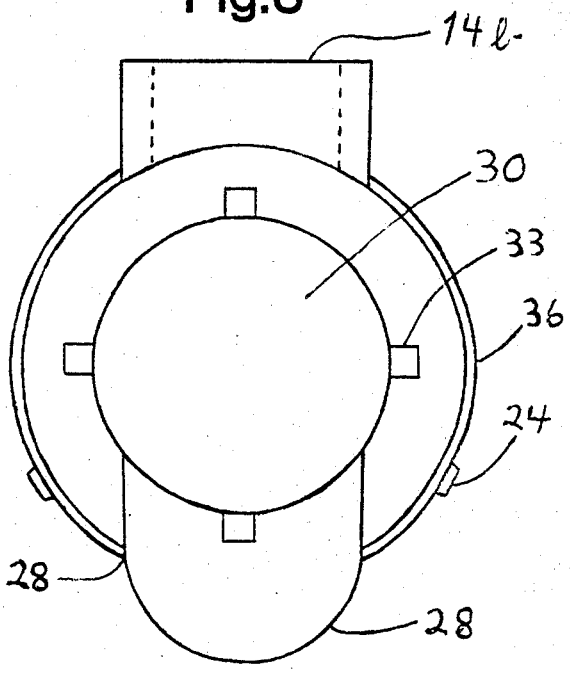
FIG. 8 is a top view of the assembly with dowelling.

The top cover 30 supports the motor 19 at the top end of the case and it can be fastened there in four (4) different ways. One of the ways to fasten the top cover 30 on is by using a spring clasp 31 shown in FIG. 1. The spring clasp 31 is barbed on one end into the case and the other end hooks the top cover down on the case end. The spring clasp 31 can be built into a plastic or metal case permanently by heat or held in place by set screws 24 or they can be held in place by a large heavy duty rubber band 39 shown in FIG. 13. The top cover 30 may also use four (4) set screws 24 alone to hold it in place. The top cover 30 may also use its own screw threads 32 at its inner diameter which can then be screwed directly into matching screw threads at the inside top of the case end where the top cover concentrically fits. The top cover may also use dowels 33 shown in FIG. 8 which would have the same position as the set screws already mentioned and the top cover 30 can then be strapped down with heavy duty rubber bands across the dowels 33 for that purpose. The top cover is utilized in conjunction with a rubber gasket 34. The rubber gasket 34 provides a cushion and helps seal the top cover of the device.

When changing a cutter blade 13, it shall be removed out of small slot 40 at the rear of the device between the upper support plate 22 and the lower support plate 23. The slot 40 is unexposed shown in FIG. 13 and is protected by the safety ring 36. The safety ring must be disconnected and the top cover 30 is taken off and the motor 19 is partially removed or can be taken out the top of the case while the cutter blade 13 is removed from the rear slot 40.

The electric cord 37 for the motor 19 is shown near the top of the case at the rear side. The electric cord 37 may be kept through the top cover 30 and the wire leads inside the case should be about six inches long and should be wrapped around the motor and this will give the motor some additional slack for when being removed and the electric cord may protrude through any portion near the rear of the case. The electric cord 37 is held in place by a rubber grommet 41, and the entire device is more or less completely sealed air tight.

What I claim is:

1. Hair cutting apparatus comprising, a. a main body case, b. an electric motor mounted in said case, and having a rotary shaft with an axis of rotation, c. said case having a nozzle opening therein and located in radially offset relation to the axis of rotation of the motor shaft, d. a nozzle mounted in said case surrounding said opening and having its lower end constructed to permit engaging the surface of a person's head to ride thereon, e. a cutter blade connected to the motor shaft and mounted to rotate in a path across the upper end of said nozzle to cut off hair extending through said nozzle, the length of the hair cut being determined by the distance between the lower end of the nozzle and the cutter blade path, f. means for adjusting the distance between the lower end of the nozzle and the path of the cutter blade, g. a vacuum opening in said case above the nozzle and located on the opposite side from the nozzle opening communicating with said nozzle opening to draw hair through the nozzle into the path of the cutter blade, and cause the hair to stand up in the path of the cutter blade and also draw off the cut hair, and h. a pair of support plates disposed on opposite sides of said cutter blade, said plates being provided with aligned, notched-out segments located in diametrically opposed relation to the vacuum opening and in registration with each other and with the nozzle opening to surround the major portion of the cutter blade path and expose only the outer end portion of the cutter blade to the hair as it enters said opening through the nozzle, thus providing substantially uniform maximum cutter speed for cutting all of the hair.

2. The structure set forth in claim 1 and a safety guard formed by a plurality of spaced-apart guard wires extending across the lower end of the nozzle to permit hair to pass there-through but preventing the user's fingers from passing there-through.

3. The structure set forth in claim 1 wherein the notched segment of the upper plate extends radially deeper into said plate than the notched segment in the lower plate, to provide clearance for the cut hair to be drawn across to the vacuum opening on the opposite side of the casing.

* * * * *